United States Patent [19]

Okorodudu

[11] 4,036,773

[45] July 19, 1977

[54] LUBRICANT COMPOSITIONS CONTAINING CARBOXYLIC ACID ESTERS OF HINDERED HYDROQUINONES

[75] Inventor: Abraham O. M. Okorodudu, West Deptford, N.J.

[73] Assignee: Mobil Oil Corporation, New York, N.Y.

[21] Appl. No.: 536,777

[22] Filed: Dec. 27, 1974

[51] Int. Cl.[2] ..... C10M 1/24

[52] U.S. Cl. ..... 252/56 R; 252/56 S; 252/407

[58] Field of Search ..... 252/56 R, 56 S, 407

[56] References Cited

U.S. PATENT DOCUMENTS

| | | | |
|---|---|---|---|
| 3,116,305 | 12/1963 | Morris et al. | 252/56 R |
| 3,285,855 | 11/1966 | Dexter et al. | 252/407 X |
| 3,644,281 | 2/1972 | Meltsner | 252/56 R |
| 3,681,431 | 8/1972 | Dexter et al. | 252/407 X |
| 3,682,853 | 8/1972 | Barie et al. | 252/407 X |
| 3,801,540 | 4/1974 | Dexter et al. | 252/56 R X |
| 3,830,828 | 8/1974 | Eggensperger et al. | 252/56 R X |
| 3,839,278 | 10/1974 | Dexter et al. | 252/56 R X |

*Primary Examiner*—Delbert E. Gantz
*Assistant Examiner*—Andrew H. Metz
*Attorney, Agent, or Firm*—Charles A. Huggett; Raymond W. Barclay; Claude E. Setliff

[57] ABSTRACT

Lubricants are stabilized against oxidation by adding thereto a stabilizing amount of an ester of a hindered hydroquinone. An example of a suitable material is (4-hydroxy-3,5-di-t-butylphenyl)laurate.

10 Claims, No Drawings

LUBRICANT COMPOSITIONS CONTAINING CARBOXYLIC ACID ESTERS OF HINDERED HYDROQUINONES

SUMMARY OF THE INVENTION

In accordance with the invention, there is provided a lubricant composition comprising a major proportion of a lubricant and a minor amount sufficient to impart antioxidant properties thereto of an esterified hindered hydroquinone of the formula

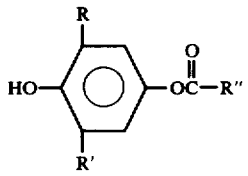

wherein R and R' contain from 3 to 20 carbon atoms and are selected from the group consisting of alkyl, cycloalkyl, aryl (e.g. phenyl, naphthyl and anthryl) aralkyl and alkaryl. R and R' are preferably alpha branched alkyls. R'' contains from 1 to 25 carbon atoms and is selected from the same groups enumerated for R and R'.

DESCRIPTION OF SPECIFIC EMBODIMENTS

The esters of hindered hydroquinone in the practice of this invention are generally prepared by adding a carboxylic acid chloride to a solution of an equimolar amount of the hindered hydroquinone in triethylamine and 1,2-dimethoxyethane. When the resulting exothermic reaction subsides, the reaction mixture is heated briefly (30–45 minutes) to 50–60° C, while stirring. The heat is turned off, and the mixture stirred for an additional 2 hours and allowed to stand. At room temperature, it is poured into cold water, and the product, if solid, precipitates. It is then collected and washed with water and dried in air. It may be further purified by recrystallization from a suitable solvent, e.g. benzene, petroleum, ether, and the like.

If there is no precipitate on addition of the reaction mixture to water, the entire mixture is extracted with benzene or ether and, the organic extract stripped and distilled to give the product.

An alternative method is the direct esterification of the carboxylic acid with the hindered (2,6-disubstituted hydroquinone) in the presence of a catalytic amount of toluenesulfonic acid or a mineral acid, in benzene as solvent. During this reaction process, the benzene-water azeotrope is removed (with a suitable apparatus such as a Dean-Stark apparatus) to drive the reaction to completion.

When used as antioxidants, the products disclosed herein are effective at a concentration of from about 0.05% to about 15% by weight of the lubricant. Preferably, such concentration shall be from about 0.01% to about 10% by weight thereof, and more preferably from about 1.0% to about 5.0% by weight.

BACKGROUND OF THE INVENTION

1. Field of the Invention

This invention relates to the inhibition of oxidation in lubricants. More particularly, the invention concerns lubricants in which have been placed an additive capable of reducing oxidation thereof.

2. Discussion of the Prior Art

Lubricants, such as oils and greases, are subject to oxidative deterioration at elevated temperatures or upon prolonged exposure to the elements. Such deterioration is evidenced, in many instances, by an increase in acidity and in viscosity, and when the deterioration is severe enough, it can cause metal parts to corrode. Additionally, severe oxidation leads to a loss of lubrication properties of the lubricants, and, in especially severe cases, to complete breakdown of the device being lubricated. In combatting oxidation, many additives have been tried, but many of them are only marginally effective except at high concentration, especially when the lubricant is subjected to drastic oxidizing conditions.

No references are known that disclose or suggest the additives of this invention. It will be shown herein that the unesterified hindered hydroquinones are not effective. Tending to confirm this is U.S. Pat. No. 3,095,287, which discloses that a similar hindered phenol (4-methyl-2,6-di-tert-butyl phenol) fails to provide thermal stability in jet fuels.

The compounds are useful in a variety of lubricants. Those which may be improved by adding the hindered hydroquinone thereto are mineral and synthesized lubricating oils, as well as greases made therefrom. The mineral oils will be understood to embrace not only the paraffinic, but also the naphthenic and aromatic-containing members. By synthesized oils are meant synthesized hydrocarbons, polyalkylene oxide oils, polyacetals, polysilicones and the like, as well as synthetic ester oils. Of the latter type there may be mentioned esters made from monohydric alcohols and polycarboxylic acids, such as 2-ethylhexyl azelate and the like, and those made from polyhydric alcohols and aliphatic monocarboxylic acids. Those of this group are especially important, and they include esters prepared from the polymethylols, as for example, the trimethylols, such as ethane, propane and butane derivatives thereof, 2,2-disubstituted propane diols and the pentaerythritols with aliphatic monocarboxylic acids containing from about 4 to about 9 carbon atoms. Mixtures of these acids may be used to prepare the esters. Preferred in the practice of this invention are the esters prepared from a pentaerythritol and a mixture of $C_5$–$C_9$ acids. In making such esters, a generally acceptable product can be made from commercial pentaerythritol containing about 88% monopentaerythritol and 12% dipentaerythritol.

Having described the invention in general terms, the following is offered as a specific embodiment thereof. It will be understood that the example is merely for the purpose of illustration, and there is no intention to limit the scope of the invention to the member shown.

The process for preparing the compounds used in this invention is the same for all of them, except for the halide used, and is typified by the following example:

EXAMPLE 1

Preparation of (4-hydroxy-3,5-di-t-butylphenyl)laurate

-continued

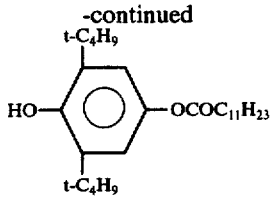

To a solution of 19.5g (0.088 moles) of 2,6-di-t-butyl hydroquinone in triethylamine (15 ml) and 1,2-dimethoxyethane (60 ml) in a 4-necked reaction flask equipped with a mechanical stirrer, condenser, thermometer and an addition funnel, was added, dropwise, 19.8g (0.09 moles) of lauryl chloride. The reaction was protected from moisture by drying tube attachment to the condenser.

When the exothermic reaction subsided, the reaction mixture was heated briefly (45 minutes) at 50°–60° C and then stirred without external heating for 2 hours. After cooling to room temperature, the mixture was poured into cold water and extracted three times with ether. The organic extract was stripped of solvent and the residue distilled to give a liquid product, bp 180–190 at 0.1 mm Hg.

EVALUATION OF PRODUCTS

Oxidation

To illustrate the antioxidant effect of the compounds described herein, they were combined with a lubricating oil prepared from pentaerythritol and an acid mixture containing $C_5$ and $C_9$ monocarboxylic acids in approximately equimolar amounts or with a polydecene oil and tested as follows:

In this test, a catalytic oxidation test for lubricants, the lubricant composition is subjected to a stream of air which is bubbled through the composition at a rate equivalent to 5 liters per hour at 425° F and 450° F for 24 hours. Present in the composition are metals known to be catalysts for oxidation namely:

a. sand-blasted iron wire;
b. polished copper wire;
c. polished aluminum wire; and
d. polished lead.

Inhibitors for oil are rated on the basis of their ability to prevent oil deterioration by measuring the change in acid formation or neutralization number (NN) and kinematic viscosity (ΔKV) occasioned by the oxidation. While some antioxidants will yield improvements in both of the named criteria, an improvement in even one of them indicates an effective additive.

The hindered compounds were tested in the oxidation test described, giving the results shown in Tables I and II. Table I shows the results with an ester lubricating oil; Table II shows the results using a synthetic hydrocarbon lubricating oil.

TABLE I

CATALYTIC OXIDATION TEST
24 HOUR SYNTHETIC ESTER BASE STOCKS*

| | | | | Viscosity, KV at 100° F | | Acidity, NN | | Oxidized Oil | |
|---|---|---|---|---|---|---|---|---|---|
| Example | Additive | Conc. Wt.% | Temp. °F | Initial | Final | Initial | Final | Δ NN | Δ KV% |
| — | None | — | 425 | — | — | — | — | 7.9 | 445 |
| — | None | — | 450 | — | — | — | — | 3.8 | 830 |
| 1 | (4-Hydroxy-3,5-di-t-butylphenyl) laurate | 4 | 425 | 27.66 | 38.28 | 0.10 | 2.0 | 1.90 | 38.4 |
| | | 2 | | | 38.18 | | 1.0 | 0.75 | 38.0 |
| | | 1 | | | 33.81 | | 1.0 | 0.98 | 22.2 |
| | | 4 | 450 | | | | | | |
| | | 2 | | | 37.12 | | 1.8 | 1.75 | 34.2 |
| | | 1 | | | 38.96 | | 2.0 | 1.97 | 40.9 |
| 2 | 2,6-di-t-butyl-hydroquinone | 4 | 425 | 30.17 | 201.8 | 0.05 | 12.3 | 12.25 | 586 |
| | | 2 | | | 172.2 | | 12.9 | 12.88 | 470 |
| | | 1 | | | 180.1 | | 12.3 | 12.29 | 497 |
| | | 4 | 450 | 30.17 | — | | — | — | — |
| | | 2 | | | 328.5 | | 10.2 | 10.18 | 995 |
| | | 1 | | | 309.0 | | 10.7 | 10.69 | 930 |
| 3 | (4-Hydroxy-3,5-t-butyl hexanoate | 4 | 425 | 25.58 | 33.94 | 0.25 | 1.8 | 1.55 | 23.1 |
| | | 2 | | | 33.87 | | 2.8 | 2.67 | 22.8 |
| | | 1 | | | 35.25 | | 2.3 | 2.24 | 27.8 |
| | | 4 | 450 | | 46.39 | | 3.6 | 3.35 | 68.2 |
| | | 2 | | | 49.19 | | 3.8 | 3.07 | 78.4 |
| | | 1 | | | 51.40 | | 3.1 | 3.03 | 86.4 |
| 4 | (4-Hydroxy-3,5-t-butylphenyl) pivalate | 4 | 425 | 28.37 | 37.0 | 0.13 | 2.5 | 2.37 | 30.4 |
| | | 2 | | | 42.20 | | 3.1 | 3.04 | 48.7 |
| | | 1 | | | 41.55 | | 2.5 | 2.47 | 46.5 |
| | | 4 | 450 | 28.31 | — | 0.13 | 3.8 | 3.67 | — |
| | | 2 | | | 53.96 | | 3.3 | 3.24 | 90.6 |
| | | 1 | | | 47.65 | | 3.3 | 3.27 | 68.3 |
| 5 | (4-Hydroxy-3,5-di-t-butylphenyl) benzoate | 4 | 425 | 29.48 | 44.23 | 0.05 | 2.3 | 2.25 | 50.4 |
| | | 2 | | | 36.45 | | 2.0 | 1.98 | 23.6 |
| | | 1 | | | 35.01 | | 1.5 | 1.47 | 18.8 |
| | | 4 | 450 | 29.42 | 50.37 | 0.10 | 3.6 | 3.50 | 71.2 |
| | | 2 | | | 57.18 | | 2.5 | 2.45 | 94.4 |
| | | 1 | | | 46.05 | | 3.1 | 3.08 | 56.5 |

*Pentaenythritol and a mixture of $C_5$-$C_9$ aliphatic monocarboxylic

TABLE II

CATALYTIC OXIDATION TEST IN SYNTHESIZED HYDROCARBON* BASE STOCK AT 375° F, 40 HOURS

| Example | Additive | Conc. Wt% | Viscosity, KV at 100° F Initial | Viscosity, KV at 100° F Final | Acidity, NN Initial | Acidity, NN Final | Δ NN | Δ KV% |
|---|---|---|---|---|---|---|---|---|
| — | None | — | 451.5 | 26423 | 0.0 | 8.9 | 8.9 | 5752.3 |
| 1 | (4-Hydroxy-3, | 4 | 410.7 | 1231 | 0.05 | 7.1 | 7.05 | 199.6 |
| | 5-di-t-butyl | 1 | | 3336 | | 6.9 | 6.89 | 711.9 |
| | phenyl)laurate | | | | | | | |
| 2 | 2,6 - di-t-butyl hydroquinone | 0.5 | 443.0 | 7198 | 0.1 | 7.9 | 7.8 | 1524.8 |
| 3 | (4-Hydroxy-3,5- | 4 | 408.0 | 1262 | 0.0 | 7.6 | 7.6 | 209.3 |
| | di-t-butyl | 2 | | 1458 | | 6.6 | 6.6 | 257.3 |
| | phenyl) | 1 | | 2794 | | 6.4 | 6.4 | 584.3 |
| | hexanoate | | | | | | | |
| 4 | (4-hydroxy-3,5- | 2 | 434.4 | 3058 | 0.05 | 7.1 | 7.05 | 604.1 |
| | di-t-butyl | 1 | | 3408 | | 6.9 | 6.87 | 684.7 |
| | phenyl) | | | | | | | |
| | pivalate | | | | | | | |
| 5 | (4-hydroxy-3,5- di-t-butyl) benzoate | 1 | 446.9 | 6995 | 0.1 | 7.1 | 7.0 | 1454.2 |

*Polymerized Decene, containing primarily the trimer.

I claim:

1. A lubricant composition comprising a major amount of a mineral lubricating oil, a synthetic lubricating oil or greases thereof and an amount sufficient to impart antioxidant properites thereto of an ester of a hindered hydroquinone, said ester having the formula

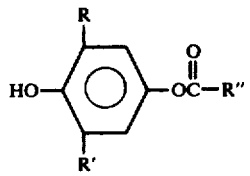

wherein R and R' contain from 3 to 20 carbon atoms and are selected from the group consisting of alkyl, cycloalkyl, aryl, aralkyl and alkaryl and R'' contains from 1 to 25 carbon atoms and is the same as R and R'.

2. The composition of claim 1 wherein R and R' are tertiary butyl groups.

3. The composition of claim 1 wherein R and R' are tertiary butyl and R'' is $C_{11}H_{23}$.

4. The composition of claim 1 wherein R and R' are tertiary butyl and R'' is $C_5H_{11}$.

5. The composition of claim 1 wherein R, R' and R'' are tertiary butyl.

6. The composition of claim 1 wherein R and R' are tertiary butyl and R'' is phenyl.

7. The composition of claim 1 wherein the lubricant is a synthetic ester lubricating oil.

8. The composition of claim 7 wherein the synthetic ester oil is an oil made from pentaerythritol and a mixture of $C_5$–$C_9$ aliphatic monocarboxylic acids.

9. The composition of claim 7 wherein the lubricating oil is a synthetic hydrocarbon oil.

10. The composition of claim 9 wherein the synthetic hydrocarbon oil is a decene trimer.

* * * * *